US009630407B1

(12) United States Patent
Spence et al.

(10) Patent No.: US 9,630,407 B1
(45) Date of Patent: Apr. 25, 2017

(54) PRINT HEAD WITH CURVED NOZZLE PLATE

(71) Applicant: XEROX CORPORATION, Norwalk, CT (US)

(72) Inventors: James J. Spence, Honeoye Falls, NY (US); Mark A. Atwood, Rush, NY (US); Jack Gaynor Elliot, Penfield, NY (US); Marc D. Daniels, Webster, NY (US)

(73) Assignee: XEROX CORPORATION, CT (US)

( * ) Notice: Subject to any disclaimer, the term of this patent is extended or adjusted under 35 U.S.C. 154(b) by 0 days.

(21) Appl. No.: 15/058,114

(22) Filed: Mar. 1, 2016

(51) Int. Cl.
*B41J 2/14* (2006.01)

(52) U.S. Cl.
CPC .. *B41J 2/14233* (2013.01); *B41J 2002/14419* (2013.01)

(58) Field of Classification Search
CPC ..... B41J 2/14233
See application file for complete search history.

(56) References Cited

U.S. PATENT DOCUMENTS 6,386,684 B1 5/2002 Brennan et al.
2004/0130601 A1* 7/2004 Shimada ..... B41J 2/14233 347/68

FOREIGN PATENT DOCUMENTS

EP 0620117 A3 10/1997

* cited by examiner

*Primary Examiner* — Stephen Meier
*Assistant Examiner* — Alexander D Shenderov
(74) *Attorney, Agent, or Firm* — MH2 Technology Law Group LLP

(57) ABSTRACT

A print head includes a backup plate and a nozzle plate. The backup plate has a non-planar lower surface. The nozzle plate also has a non-planar lower surface. The nozzle plate is coupled to the lower surface of the backup plate.

17 Claims, 6 Drawing Sheets

FIG. 3

PRINT HEAD WITH CURVED NOZZLE PLATE

TECHNICAL FIELD

The present teachings relate generally to print heads and, more particularly, to systems and methods for printing onto a non-planar surface.

BACKGROUND

A gap exists between a print head and the surface of the object to which it prints (e.g., a piece of paper). This gap is often referred to as the "print head gap." The print head gap is typically between about 1 mm and about 5 mm. It is desirable to have the print head gap remain as constant as possible because variations in the print head gap may reduce the quality of the printed images. When the object is a piece of paper, the print head gap remains substantially constant during printing, resulting in high-quality printed images. However, when the surface of the object is not planar, variations in the print head gap may occur, reducing the quality of the printed images.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A print head is disclosed. The print head includes a backup plate and a nozzle plate. The backup plate has a non-planar lower surface. The nozzle plate also has a non-planar lower surface. The nozzle plate is coupled to the lower surface of the backup plate.

In another embodiment, the print head includes a piezoelectric transducer. A diaphragm is coupled to and positioned below the piezoelectric transducer. An ink manifold is coupled to and positioned below the diaphragm. A nozzle plate is positioned below the backup plate. The nozzle plate is coupled to the ink manifold. The piezoelectric transducer, the diaphragm, the ink manifold, and the nozzle plate each have a radius of curvature from about 10 mm to about 75 mm, and the radius of curvature of the nozzle plates is within 10% of a radius of curvature of an object onto which the print head transfers ink. The piezoelectric transducer deforms in a radial direction when exposed to an electrical current. The deformation is from about 0.2 mm to about 1 mm, and a variation in the deformation between any two points along a curvature of the piezoelectric transducer is less than or equal to about 0.2 mm. The deformation of the piezoelectric transducer causes the diaphragm to generate a pressure within in the ink manifold, which causes ink to flow from the ink manifold through a plurality of apertures in the nozzle plate.

A method for printing on a non-planar surface of an object includes coupling a backup plate to a housing of a print head. A lower surface of the backup plate is non-planar. A nozzle plate is coupled to the lower surface of the backup plate. A lower surface of the nozzle plate is non-planar. A non-planar object is moved with respect to the lower surface of the nozzle plate. Ink is transferred from the print head to the object as the object is moved with respect to the lower surface of the nozzle plate.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same, similar, or like parts.

Figure 1:
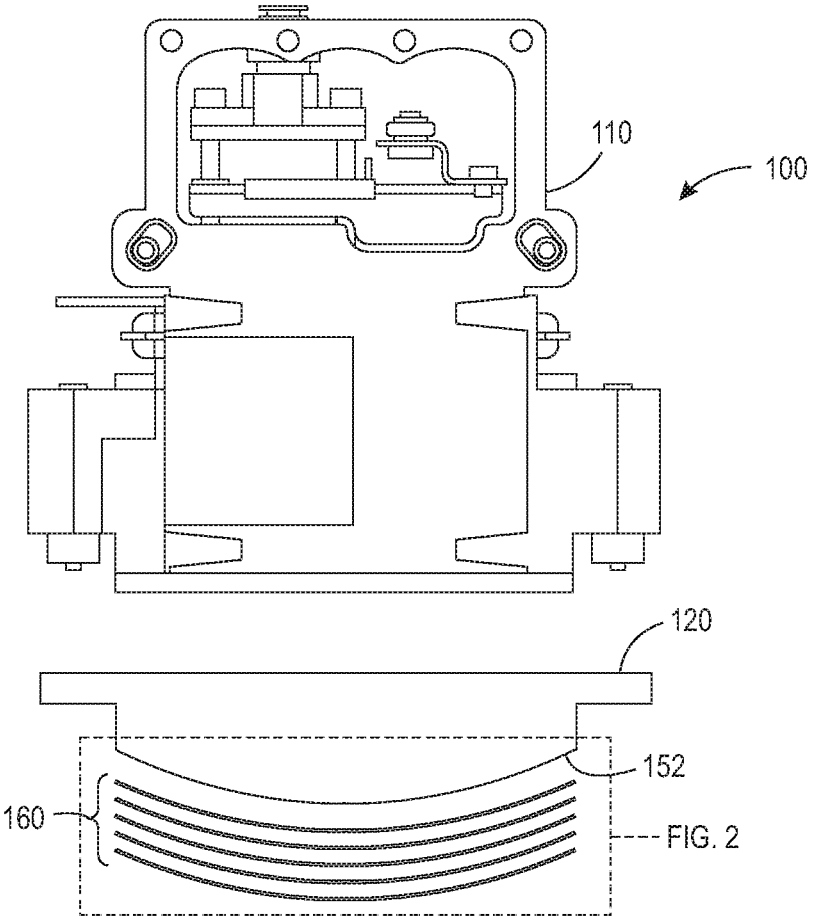
FIG. 1 depicts a side view of a print head, according to an embodiment.

FIG. 1 depicts a side view of a print head 100, according to an embodiment. The print head 100 may include a housing 110. A backup plate 120 may be coupled to the housing 110. In other embodiments, the backup plate 120 may be referred to as an adapter plate. A lower surface 152 of the backup plate 120 may be non-planar (e.g., curved). One or more additional layers 160 may be coupled to a lower surface 152 of the backup plate 120. The additional layers 160 may also be non-planar (e.g., curved) to conform to the lower surface 152 of the backup plate 120.

Figure 2:
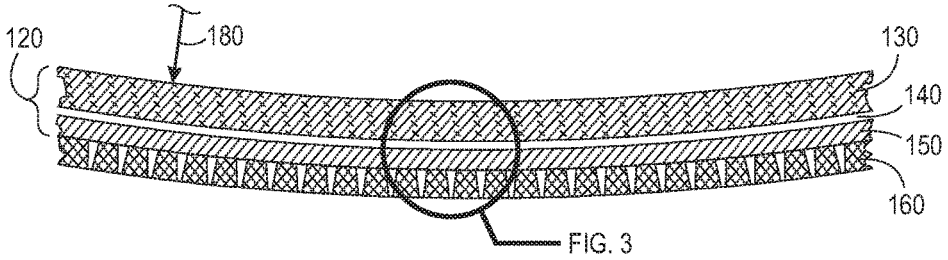
FIG. 2 depicts an enlarged cross-sectional view of a portion of the print head shown in FIG. 1, according to an embodiment.
Figure 3:
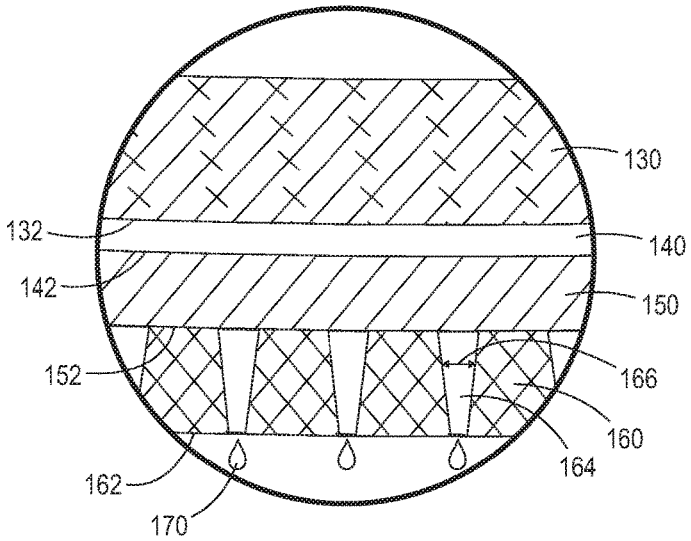
FIG. 3 depicts an enlarged cross-sectional view of a portion of the print head shown in FIG. 2, according to an embodiment.

FIG. 2 depicts an enlarged cross-sectional view of a portion of the print head 100 shown in FIG. 1, and FIG. 3 depicts an enlarged cross-sectional view of a portion of the print head 100 shown in FIG. 2, according to an embodiment. The backup plate 120 may include a piezoelectric transducer 130, a diaphragm 140, and an ink manifold 150. When the piezoelectric transducer 130 is in its default state (i.e., when not exposed to an electrical current), a lower surface 132 of the piezoelectric transducer 130 may be non-planar (e.g., curved). As shown, the lower surface 132 of the piezoelectric transducer 130 is convex; however, in other embodiments, the lower surface 132 of the piezoelectric transducer 130 may be concave or any other curved shape.

The lower surface 132 of the piezoelectric transducer 130 may be coupled to an upper surface of the diaphragm 140. As such the upper surface of the diaphragm 140 may conform to the curved shape of the lower surface 132 of the piezoelectric transducer 130. A lower surface 142 of the diaphragm 140 may be non-planar (e.g., curved). As shown, the lower surface of the diaphragm 140 is convex; however, in other embodiments, the lower surface 142 of the diaphragm 140 may be concave or any other curved shape.

The lower surface 142 of the diaphragm 140 may be coupled to an upper surface of the ink manifold 150. As such the upper surface of the ink manifold 150 may conform to the curved shape of the lower surface 142 of the diaphragm 140. A lower surface 152 of the ink manifold 150 may be non-planar (e.g., curved). As shown, the lower surface 152 of the ink manifold 150 is convex; however, in other embodiments, the lower surface 152 of the ink manifold 150 may be concave or any other curved shape. The lower surface 152 of the ink manifold 150 may be the same as the lower surface 152 of the backup plate 120 (mentioned above with respect to FIG. 1), as the ink manifold 150 may be the lowest layer of the backup plate 120.

The lower surface 152 of the ink manifold 150 may be coupled to an upper surface of one or more plates (e.g., intermediate plates and a nozzle plate) 160. As such, the upper surface of the plates 160 may conform to the curved shape of the lower surface 152 of the ink manifold 150. Lower surfaces 162 of the plates 160 may be non-planar (e.g., curved). As shown, the lower surfaces 162 of the plates 160 are convex; however, in other embodiments, the lower surfaces 162 of the plates 160 may be concave or any other curved shape.

The plates 160 may each include one or more orifices 164 that extend from the upper surface to the lower surface 162. As such, ink 170 may flow from the ink manifold 150, through the orifices 164, and to an object (e.g., a piece of paper), as described in greater detail below. The orifices 164 may have a greater cross-sectional width 166 proximate to the upper surface of the plates 160 than proximate to the lower surface 162 of the nozzle plates 160. The cross-sectional width 166 may include a tapered portion (e.g., tapering down moving toward the lower surface 162) and a substantially-constant diameter portion positioned below the tapered portion.

The piezoelectric transducer 130, the diaphragm 140, the ink manifold 150, and/or the plates 160 may have a radius of curvature 180. The radius of curvature 180 may be from about 5 mm to about 100 mm, from about 10 mm to about 75 mm, or from about 20 mm to about 50 mm. In another embodiment, rather than a radius of curvature 180, the lower (and/or upper) surfaces of the piezoelectric transducer 130, the diaphragm 140, the ink manifold 150, and/or the plates 160 may include two planar portions that are oriented at an angle with respect to one another. The two planar portions of the plates 160 may each have at least one orifice 164 extending therethrough. The angle may be from about 160° to about 200°.

Figure 4:
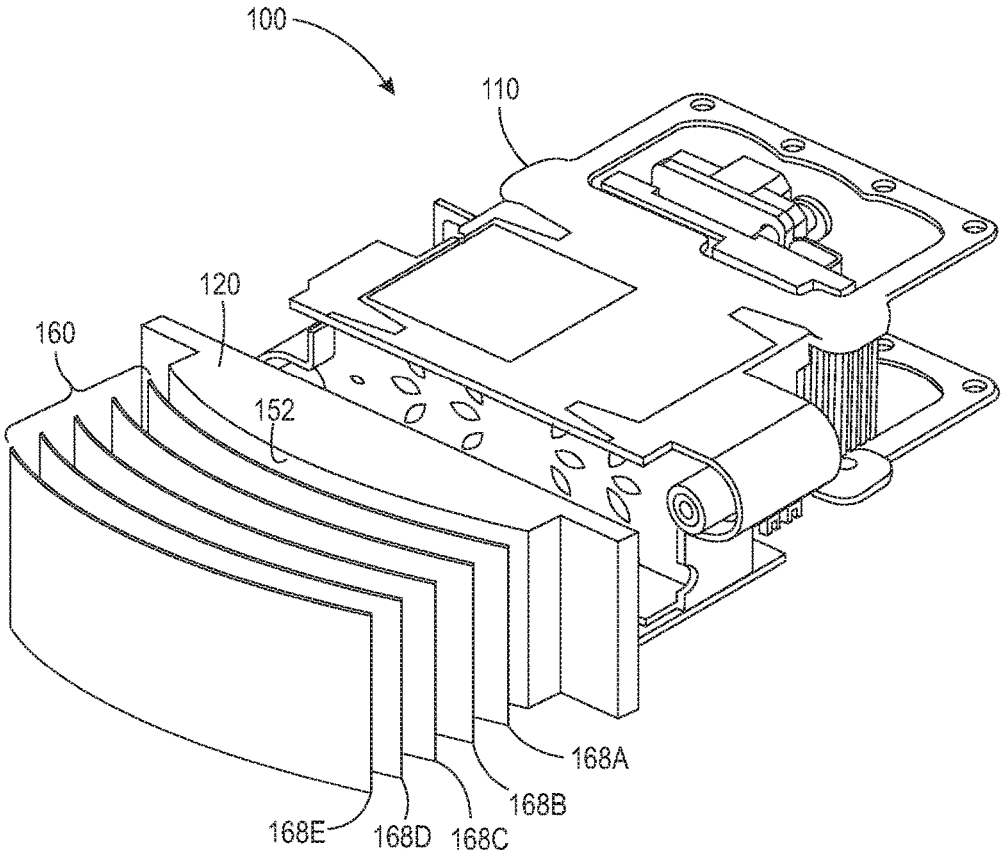
FIG. 4 depicts a perspective view of the print head having a plurality of nozzle plates that are convex, according to an embodiment.

FIG. 4 depicts a perspective view of the print head 100 having a plurality of plates 160 that are convex, according to an embodiment. Five plates are shown: 168A-E; however, as will be appreciated, the number of plates may be greater or fewer. The plates may include a plurality of intermediate plates 168A-D and a nozzle plate 168E positioned below the intermediate plates 168A-D. The plates 168A-E may each conform to the shape of the lower surface 152 of the backup plate 120. In this example, the plates 168A-E and the lower surface 122 of the backup plate 120 are convex. The plates 168A-E may each have orifices 164 (see FIG. 3) extending therethrough, and the orifices 164 in one plate (e.g., plate 168B) may be aligned with the orifices 164 in layers above and below (e.g., plates 168A, 168C). The layers 168A-E may be made of stainless steel.

Figure 5:
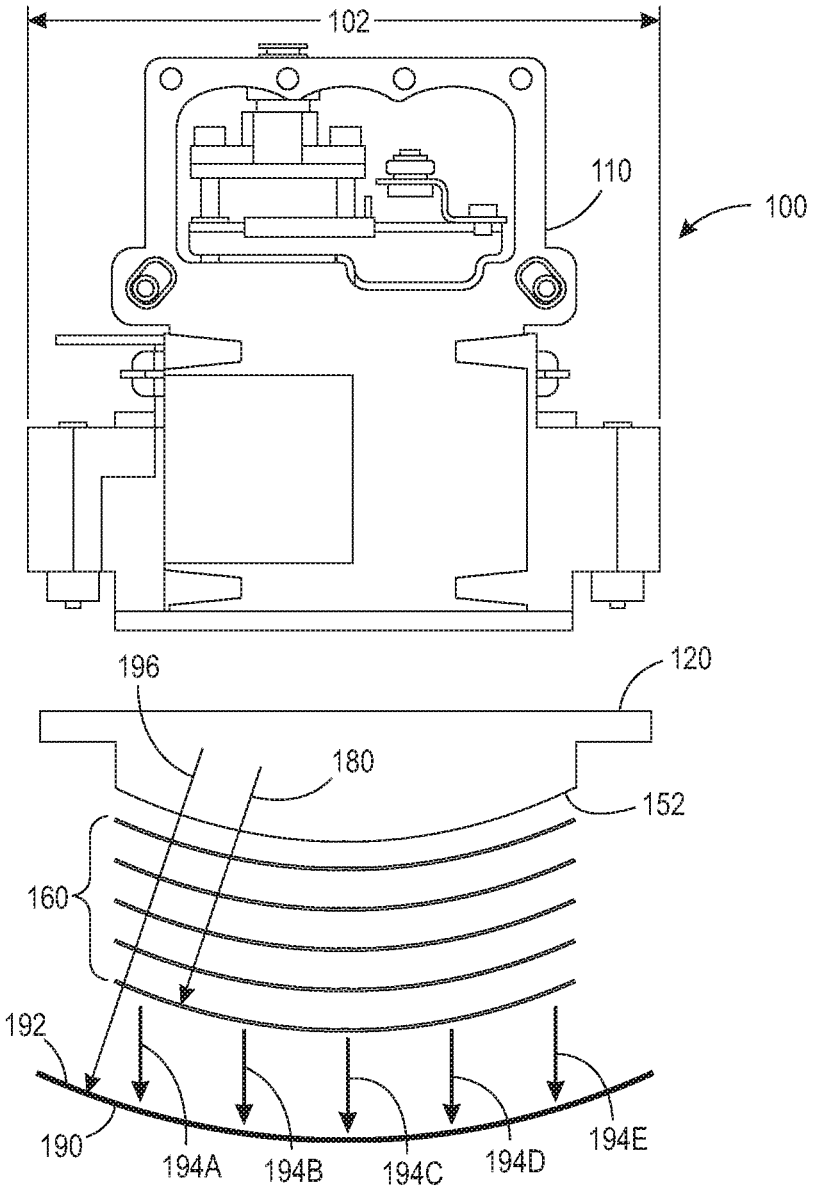
FIG. 5 depicts a side view of the print head having the convex nozzle plate positioned over a concave object, according to an embodiment.

FIG. 5 depicts a side view of the print head 100 having the convex plates 160 positioned over a concave object 190, according to an embodiment. The object 190 may be or include a piece of paper, footwear, clothing, packaging, bottles, sports balls (e.g., basketballs, footballs, etc.), optical lenses, or any other non-planar object. As shown, the shape (e.g., convex) of the backup plate 120 and the plates 160 may correspond to the shape (e.g., concave) of the object 190 onto which the print head 100 is printing. This may allow a print head gap 194A-E (i.e., the distance between the lower surface 162 of the plates 160 and the object 190) to remain more constant along a width 102 of the print head 100 during printing than if the print head 100 (e.g., the lower surface 162 of the plates 160) was planar. In the example shown in FIG. 5, the print head gap 194A-E may be substantially constant (e.g., about 3 mm) at five different points along the width 102 of the print head 100. In contrast, if the print head 100 (e.g., the lower surface 162 of the plates 160) was planar while printing on a concave object 190, the print head gap 194A-E might be 2 mm at the first point 194A, 4 mm at the second point 194B, 6 mm at the third point 194C, 4 mm at the fourth point 194D, and 2 mm at the fifth point 194E, resulting in a lower-quality image.

Figure 6:
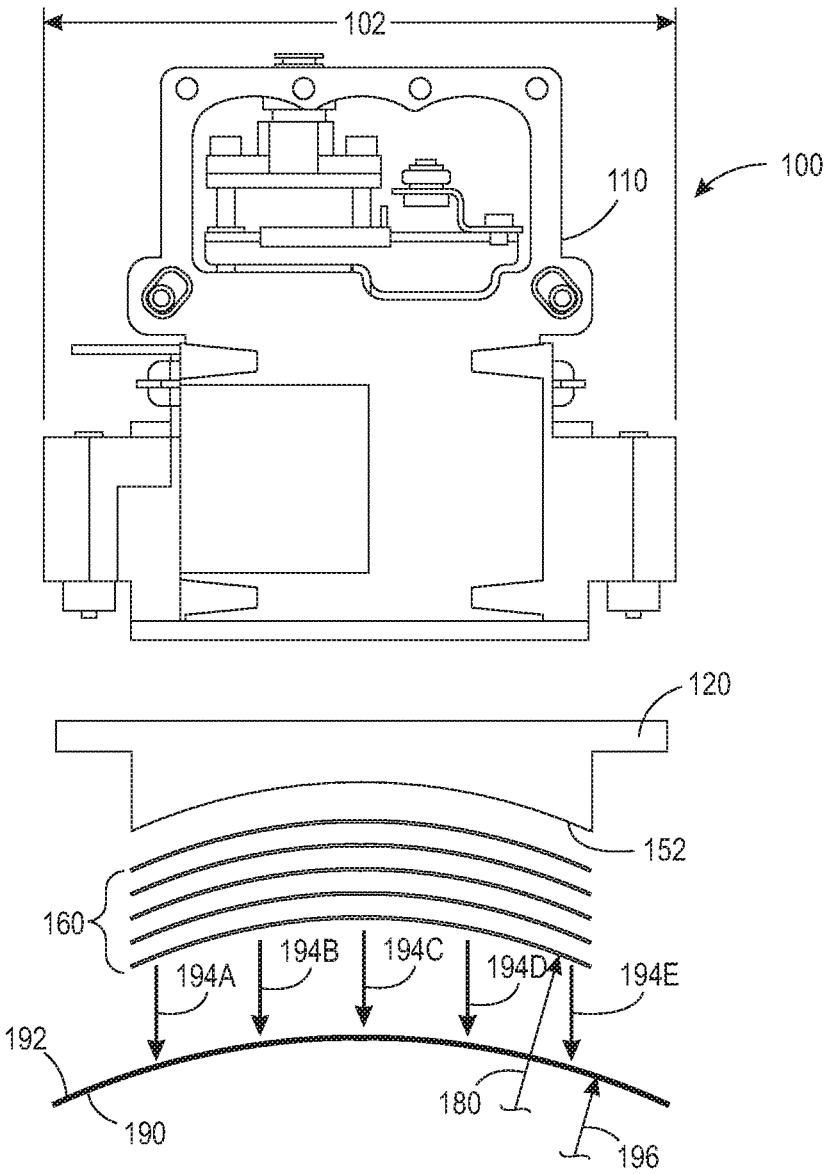
FIG. 6 depicts a side view of the print head having a nozzle plate that is concave positioned over a convex object, according to an embodiment.

FIG. 6 depicts a side view of the print head having plates 160 that are concave positioned over a convex object 190, according to an embodiment. As shown, the shape (e.g., concave) of the backup plate 120 and the plates 160 may correspond to the shape (e.g., convex) of the object 190 onto which the print head 100 is printing. This may allow the print head gap 194A-E to remain more constant along the width 102 of the print head 100 during printing than if the print head 100 (e.g., the lower surface 162 of the plates 160) was planar. In the example shown in FIG. 6, the print head gap 194A-E may be substantially constant (e.g., about 3 mm) at five different points along the width 102 of the print head 100. In contrast, if the print head 100 (e.g., the lower surface 162 of the plate 160) was planar while printing on a convex object 190, the print head gap 194A-E might be 6 mm at the first point 194A, 4 mm at the second point 194B, 2 mm at the third point 194C, 4 mm at the fourth point 194D, and 6 mm at the fifth point 194E, resulting in a lower-quality image.

The radius of curvature 180 of the piezoelectric transducer 130, the diaphragm 140, the ink manifold 150, and/or the plates 160 may be within (e.g., +/−) 10% of a radius of curvature 196 of the object 190 onto which the print head 100 transfers ink 170 (e.g., to produce an image). In addition, the print head gap 194A-E may vary along the width 102 of the print head 100 by less than a distance between a planar lower surface of the housing 110 and the surface 192 of the object 190 varies.

Figure 7:
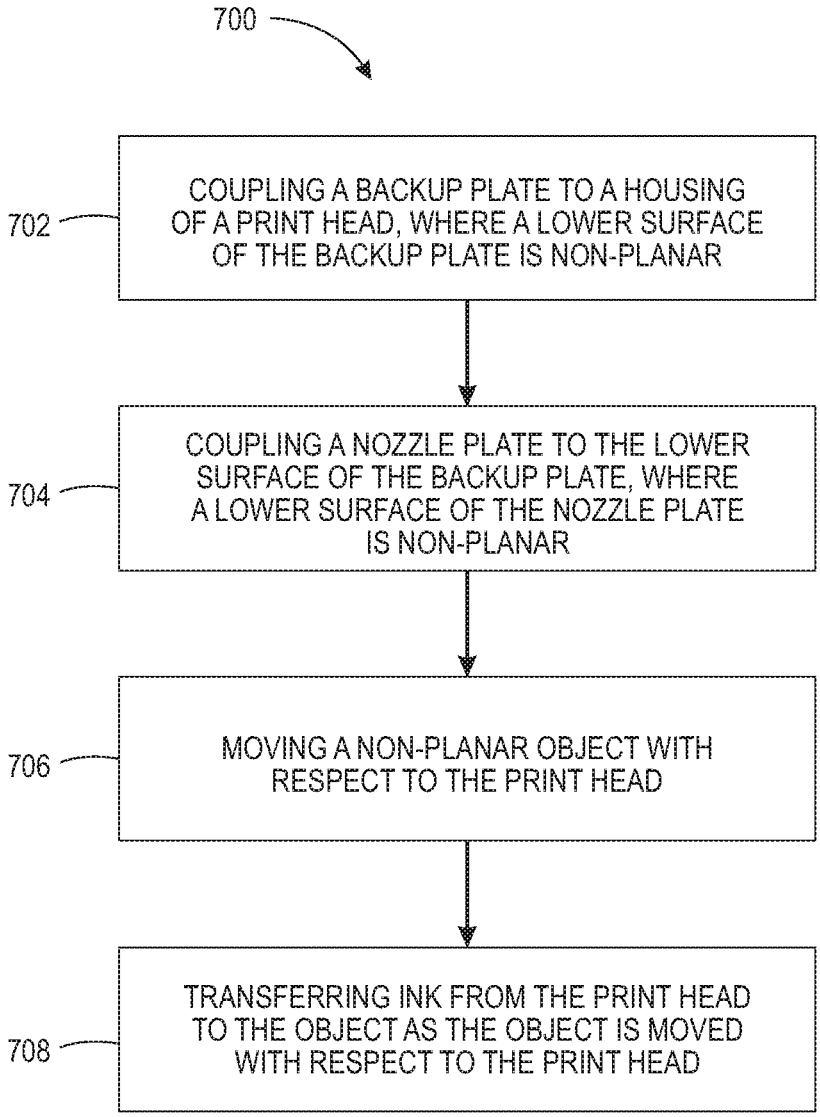
FIG. 7 depicts a flowchart of a method for printing onto a non-planar object, according to an embodiment.

FIG. 7 depicts a flowchart of a method 700 for printing onto a non-planar object 190, according to an embodiment. The method 700 may include coupling a backup plate 120 to a housing 110 of a print head 100, where a lower surface 152 of the backup plate 120 is non-planar, as at 702. For example, the lower surface 152 may be concave, convex, or include two planar portions that are oriented at a non-180° angle with respect to one another. The method 700 may also include coupling a plate 160 (e.g., a nozzle plate 168E) to the lower surface 152 of the backup plate 120, where a lower surface 162 of the plate 160 is non-planar, as at 704.

The method 700 may then include moving a non-planar object 190 with respect to the print head 100, as at 706. For example, a surface 192 of the object 190 may be concave, convex, or include two planar portions. The object 190 may be moved in a direction with respect to the print head 100 such that the print head gap 194A-E remains substantially constant during the movement. Looking at FIGS. 5 and 6, the object 190 may move in a direction that is into or out of the page, as opposed to the left or right. In one example, the print head gap 194A-E may not vary by more than about 6 mm at any point along the lower surface 162 of the plate 160 as the object 190 is moved. In another embodiment, the print head gap 194A-E may not vary by more than about 1 mm.

The method 700 may then include transferring ink 170 from the print head 100 to the object 190 as the object 190 is moved with respect to the print head 100, as at 708. More particularly, an electric current may be supplied to the piezoelectric transducer 130 in the form of a plurality of pulses. The piezoelectric transducer 130 may be made of a material that deforms (e.g., bends or elongates) in response to an electric field generated by the pulses of electrical current. For example, the piezoelectric transducer 130 may be or include rods that elongate in response to the electromagnetic field, or the piezoelectric transducer 130 may be or include bimorphs that bend in response to the electromagnetic field. The material may be or include a crystalline material, ceramic, bimetallic strips, fiber optic material, a laminated material, or a combination thereof.

The piezoelectric transducer 130 may deform (e.g., bend or elongate) substantially uniformly in a radial direction along the curvature of the piezoelectric transducer 130. For example, the piezoelectric transducer 130 may deform from about 1 nm to about 100 nm or from about 1 nm to about 10 nm in a radial direction, and a variation in the deformation between any two points along the curvature (e.g., the lower surface 132) of the piezoelectric transducer 130 may be less than or equal to about 1 nm.

The diaphragm 140 may bend or flex in response to the deformation of the piezoelectric transducer 130, which may exert a force on the ink manifold 150. The ink manifold 150 may have ink 170 stored therein. The force exerted by the diaphragm 140 may generate a pressure in the ink manifold 150, which causes a portion of the ink 170 to flow from the ink manifold 150, through the apertures 164 in the plate 160, and onto the surface 192 of the object 190 to produce an image. The pressure may be substantially constant in each aperture 164 along the curvature of the plates 160. For example, the pressure in two apertures 164 may vary by less than about 1 kPa, by less than about 50 Pa, or by less than about 5 Pa.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" may include any and all sub-ranges between (and including) the minimum value of zero and the maximum value of 10, that is, any and all sub-ranges having a minimum value of equal to or greater than zero and a maximum value of equal to or less than 10, e.g., 1 to 5.

While the present teachings have been illustrated with respect to one or more implementations, alterations and/or modifications may be made to the illustrated examples without departing from the spirit and scope of the appended claims. For example, it may be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It may be appreciated that structural objects and/or processing stages may be added, or existing structural objects and/or processing stages may be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. The terms "couple," "coupled," "connect," "connection," "connected," "in connection with," and "connecting" refer to "in direct connection with" or "in connection with via one or more intermediate elements or members." Finally, the terms "exemplary" or "illustrative" indicate the description is used as an example, rather than implying that it is an ideal. Other embodiments of the present teachings may be apparent to those skilled in the art from consideration of the specification and practice of the disclosure herein. It is intended that the specification and examples be considered as exemplary only, with a true scope and spirit of the present teachings being indicated by the following claims.

What is claimed is:

1. A print head, comprising:

a piezoelectric transducer having a non-planar lower surface;

a diaphragm coupled to and positioned below the piezoelectric transducer, wherein the diaphragm has a non-planar lower surface;

an ink manifold coupled to and positioned below the diaphragm, wherein the ink manifold has a non-planar lower surface; and a nozzle plate coupled to and positioned below the ink manifold, wherein the nozzle plate has a non-planar lower surface.

2. The print head of claim 1, wherein the lower surfaces of the piezoelectric transducer, the diaphragm, the ink manifold, and the nozzle plate are concave, and wherein the print head is configured to transfer ink onto a convex surface of an object.

3. The print head of claim 1, wherein the lower surfaces of the piezoelectric transducer, the diaphragm, the ink manifold, and the nozzle plate are convex, and wherein the print head is configured to transfer ink onto a concave surface of an object.

4. The print head of claim 1, wherein the piezoelectric transducer deforms in a radial direction when exposed to an electrical current, wherein the deformation is from 1 nm to 10 nm, and wherein a variation in the deformation between any two points along the lower surface of the piezoelectric transducer is less than or equal to 1 nm.

5. The print head of claim 4, wherein the deformation of the piezoelectric transducer causes the diaphragm to generate a pressure within in the ink manifold, which causes ink to flow from the ink manifold through a plurality of apertures in the nozzle plate, and wherein the pressure in any two of the apertures varies by less than or equal to 50 Pa.

6. The print head of claim 1, wherein the lower surface of the ink manifold has a radius of curvature from 10 mm to 75 mm.

7. The print head of claim 1, wherein the lower surface of the nozzle plate has a radius of curvature from 10 mm to 75 mm.

8. The print head of claim 7, wherein the radius of curvature of the nozzle plate is within 10% of a radius of curvature of a surface of an object onto which the print head transfers ink.

9. A print head, comprising:

a piezoelectric transducer;

a diaphragm coupled to and positioned below the piezoelectric transducer;

an ink manifold coupled to and positioned below the diaphragm; and a plurality of plates, wherein at least one of the plates is coupled to the ink manifold, and wherein:

the piezoelectric transducer, the diaphragm, the ink manifold, and the plates each have a radius of curvature from 10 mm to 75 mm, and the radius of curvature of the plates is within 10% of a radius of curvature of an object onto which the print head transfers ink;

the piezoelectric transducer deforms in a radial direction when exposed to an electrical current, the deformation is from 1 nm to 10 nm, and a variation in the deformation between any two points along a curvature of the piezoelectric transducer is less than or equal to 1 nm; and the deformation of the piezoelectric transducer causes the diaphragm to generate a pressure within in the ink manifold, which causes ink to flow from the ink manifold through a plurality of apertures in the plates.

10. The print head of claim 9, wherein the piezoelectric transducer, the diaphragm, the ink manifold, and the plates are concave.

11. The print head of claim 9, wherein the piezoelectric transducer, the diaphragm, the ink manifold, and the plates are convex.

12. The print head of claim 11, wherein each aperture comprises a first portion and a second portion positioned below the first portion, wherein the first portion has a width that tapers down moving toward a lower surface of the nozzle plates, and wherein the width of the second portion is substantially constant.

13. A method for printing on a non-planar surface of an object, comprising:

coupling a backup plate to a housing of a print head, wherein a lower surface of the backup plate is non-planar;

coupling a nozzle plate to the lower surface of the backup plate, wherein a lower surface of the nozzle plate is non-planar;

moving a non-planar object with respect to the lower surface of the nozzle plate; and transferring ink from the print head to the object as the object is moved with respect to the lower surface of the nozzle plate, wherein the lower surface of the nozzle plate has a radius of curvature, and wherein the radius of curvature of the nozzle plate is within 10% of a radius of curvature of the object.

14. The method of claim 13, wherein the object is moved in a direction with respect to the lower surface of the nozzle such that a print head gap remains substantially constant along a width of the print head.

15. The method of claim 14, wherein the print head gap does not vary by more than 6 mm at any point along the lower surface of the nozzle plate as the object is moved.

16. The method of claim 15, wherein the backup plate comprises a piezoelectric transducer, a diaphragm, and an ink manifold, wherein the piezoelectric transducer deforms in a radial direction when exposed to an electrical current, wherein the deformation is from 1 nm to 10 nm, wherein a variation in the deformation between any two points along a curvature of the piezoelectric transducer is less than or equal to 1 nm, and wherein the deformation of the piezoelectric transducer causes the diaphragm to generate a pressure within in the ink manifold, which causes ink to flow from the ink manifold through a plurality of apertures in the nozzle plate, and the pressure in any two of the apertures varies by less than or equal to 50 Pa.

17. The method of claim 16, wherein the object is selected from the group consisting of: footwear, clothing, packaging, a bottle, a sports ball, and an optical lens.

* * * * *